US005547129A

United States Patent [19]

Fortunato et al.

[11] Patent Number: 5,547,129

[45] Date of Patent: Aug. 20, 1996

[54] LOW PROFILE SPRAY ASSEMBLY

[75] Inventors: Fred A. Fortunato, Allison Park; Barry L. Shadle, Leechburg; Helmut Franz, Pittsburgh, all of Pa.

[73] Assignee: PPG Industries, Inc., Pittsburgh, Pa.

[21] Appl. No.: 316,148

[22] Filed: Sep. 30, 1994

[51] Int. Cl.[6] ..... B05B 1/20; B05B 7/00; B05B 15/00

[52] U.S. Cl. ..... 239/132.3; 239/418; 239/557; 239/566

[58] Field of Search ..... 239/132, 132.1, 239/132.3, 128, 548, 550, 556, 557, 566, 418

[56] References Cited

U.S. PATENT DOCUMENTS

| | | | |
|---|---|---|---|
| 2,481,961 | 9/1949 | Ward, Jr. | 239/132.3 |
| 2,971,578 | 2/1961 | Davis | 239/557 |
| 4,386,737 | 6/1983 | Antonov et al. | 239/132.3 X |
| 4,671,765 | 6/1987 | Tsai | 432/13 |
| 4,747,772 | 5/1988 | Tsai | 431/354 |

OTHER PUBLICATIONS

Industrial Spray Products Catalog 51, Spraying Systems Co., 1991.

*Primary Examiner*—Andres Kashnikow
*Assistant Examiner*—Lesley Morris
*Attorney, Agent, or Firm*—Andrew C. Siminerio

[57] ABSTRACT

The present invention provides a multiple nozzle liquid spray assembly having a longitudinally extending bar member, receivers to allow securing of nozzles along the bar, a coolant conduit extending along at least a portion of the bar, liquid and gas conduits extending along the bar in close proximity to each of the receivers, and first and second sets of passages interconnecting each of the receivers with the liquid or gas conduits. In one particular embodiment of the invention, the coolant conduit includes a first portion which extends from a coolant inlet along a first longitudinal side of the bar member and a second portion which extends from a coolant outlet along an opposing longitudinal side of the bar member. The liquid conduit and gas conduit generally parallel each other and extend along the bar member between the first and second portions of the cooling conduit.

20 Claims, 4 Drawing Sheets

LOW PROFILE SPRAY ASSEMBLY

This invention relates to a liquid spray system and in particular to a low profile spray system that may be used in a high temperature environment.

In multiple nozzle spray systems, piping arrangements are used to deliver the liquid to be sprayed and an atomizing gas to each of the nozzles. In high temperature applications, e.g. when the nozzle arrangement is used to spray a coating on a hot glass or ribbon, the arrangement must be cooled in order to maintain the structural integrity of the system and to prevent premature volatilization of the liquid to be sprayed prior to it reaching the nozzles. In addition, oftentimes the nozzle arrangement must be used in areas having limited space for locating the spray system.

It would be advantageous to provide a low profile spray arrangement that may be used in high temperature applications.

SUMMARY OF THE INVENTION

The present invention provides a multiple nozzle liquid spray assembly having a longitudinally extending bar member, receivers to allow securing of nozzles along the bar, a coolant conduit extending along at least a portion of the bar, liquid and gas conduits extending along the bar in close proximity to each of the receivers, and first and second sets of passages interconnecting each of the receivers with the liquid or gas conduits. In one particular embodiment of the invention, the coolant conduit includes a first portion which extends from a coolant inlet along a first longitudinal side of the bar member and a second portion which extends from a coolant outlet along an opposing longitudinal side of the bar member. The liquid conduit and gas conduit generally parallel each other and extend along the bar member between the first and second portions of the cooling conduit.

DETAILED DESCRIPTION OF THE INVENTION

Figure 1:
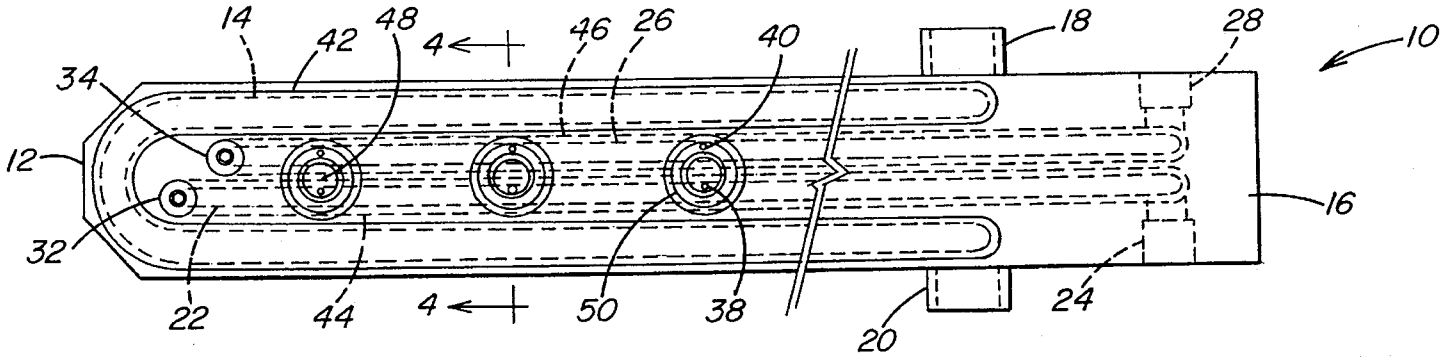
FIG. 1 is a plan view of a multiple nozzle spray arrangement disclosed in the present invention, with portions removed for clarity.

FIG. 1 illustrates a low profile, multiple nozzle spray arrangement of the present invention which may be used to apply a coating to a substrate. For example, the arrangement may be used to apply a solar reflective coating on a glass surface or coat the lower surface of a hot glass sheet or ribbon to protect against roll marking during handling. The spray arrangement includes a manifold 10 which directs the material to be sprayed and an atomizing gas to a set of nozzles positioned along the manifold 10, as will be discussed later in more detail. When the manifold is used in a high temperature environment, it must be cooled to prevent volatilization of the spray material within the manifold 10 prior to it being sprayed and further to prevent the manifold 10 from warping.

In the particular embodiment illustrated in FIGS. 1–4, manifold 10 includes a bar member 12 with cooling conduit 14 extending from surface 16 through most of bar 12's thickness, and generally extending about the bar's periphery. Coolant inlet 18 and outlet 20 are connected to opposite ends of conduit 14. Bar 12 also includes a liquid conduit 22 and a gas conduit 26 positioned along surface 30 of bar 12. Inlets 24 and 28 are located at one end of conduits 22 and 26, respectively, to supply liquid and gas to the manifold 10. Plugs 32 and 34 are positioned at the other end of conduits 22 and 26, respectively, to assist in cleaning out the manifold 10, and if required, provide additional inlets for connection to additional liquid and gas supply lines (not shown) to equalize pressure along these conduits. Although not required, coolant inlet 18, coolant outlet 20, liquid inlet 24 and gas inlet 28 are positioned along the lateral sides of the bar 26 as shown in FIG. 1. It should be further appreciated that although the cooling, liquid and gas conduits of the particular low profile spray configuration illustrated in FIGS. 1–4 are on opposite sides of the bar 12, as an alternative the conduits may all be located along the same side of the bar member 12. Conduits 22 and 26 generally parallel each other and extend the length of bar 12 between portions of coolant conduit 14. Nozzles 36 are secured to bar 12 in any convenient manner at predetermined spacings. Spray material is supplied from conduit 22 to nozzles 36 through ports 38 and pressurized gas is supplied from conduit 26 to nozzles 36 through ports 40. Plate 42 seals conduit 14 and plates 44 and 46 seal conduits 22 and 26, respectively. It should be appreciated that the conduits may be formed within the bar member 12 so that sealing plates would not be required.

In one particular embodiment of the invention, bar 12 was constructed from a stainless steel bar 2 inches (5.08 cm) wide by 1 inch (2.54 cm) thick. Plates 42, 44 and 46 are 0.125 inch (0.318 cm) thick stainless steel. Sealed conduit 14 is approximately 0.375 inches wide by 0.75 inches deep (0.953 by 1.91 cm) and sealed conduits 22 and 26 are approximately 0.25 inches wide by 0.375 inches deep (0.635 by 0.953 cm).

Figure 4A:
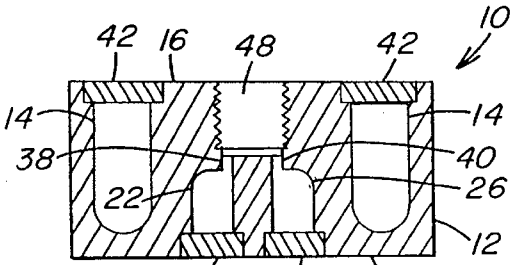

A variety of different types of nozzle 36 having different configurations and spray patterns as is well known in the art may be used in combination with the manifold 10 illustrated in FIGS. 1–4. In one particular embodiment of the invention where the manifold 10 was used to spray material on the lower surface of a hot glass ribbon to reduce roll marking, the nozzles 36 were air atomizing, flat spray, external mix nozzles available from Spraying Systems Company, Ill., and in particular type no. SUE 18B nozzles. With this particular nozzle configuration, referring to FIGS. 3 and 4, the ports 38 direct the spray material from liquid conduit 22 into nozzle receivers 48 (only one shown in FIG. 4), each of which receives a nozzle 36 (shown in FIG. 3). In addition, ports 40 direct the atomizing gas from conduit 26 into a circular groove 50 around each receiver 48 along surface 16 to better distribute the atomizing gas to this particular nozzle 36 configuration. As an alternative, both the liquid and atomizing gas may be delivered via ports 38 and 40, respectively, directly to receiver 48, as shown in FIG. 4A.

Figure 2:
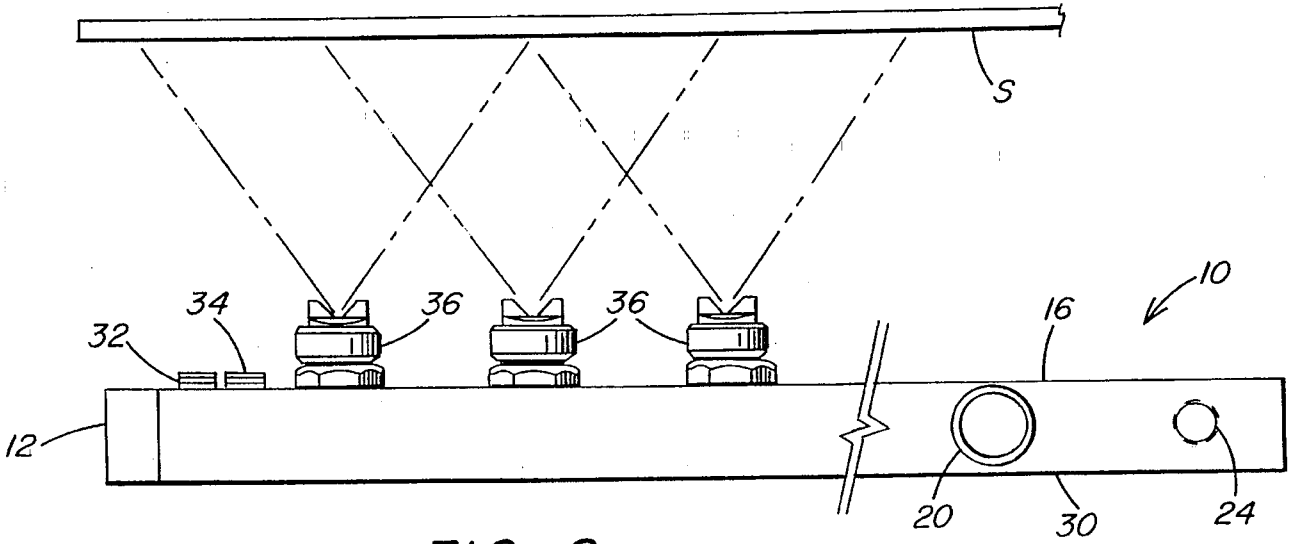
FIG. 2 is an elevational side view of the spray arrangement illustrated in FIG. 1.
Figure 4:
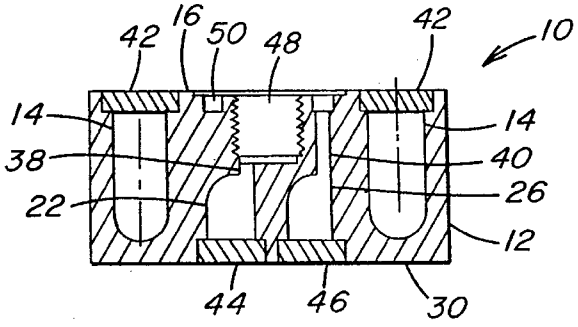
FIG. 4 is a cross-sectional view taken along line 4—4 of FIG. 1.

In using the spray arrangement illustrated in FIGS. 1–4 to apply a coating to a substrate S, the spacing of the nozzles along bar 12 and positioning of the manifold 10 relative to the substrate surface may be such that there is an overlap of the area sprayed by the nozzles 36 to ensure adequate coverage, as shown in FIG. 2.

Figure 5:
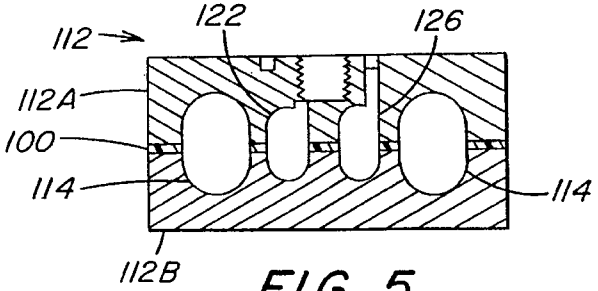
FIGS. 4A 5 and 6 are a cross-sectional views similar to that shown in FIG. 4 of alternate spray arrangements.

FIG. 5 illustrates an alternate embodiment of the invention wherein bar member 112 is divided into an upper section 112A and lower section 112B, with portions of cooling conduit 114, liquid conduit 122 and gas conduit 126 extending along opposing faces of sections 112A and 112B. When sections 112A and 112B are joined together by bolts (not shown) or another joining means, as is well known in the art, the conduits 114, 122 and 126 are formed. A gasket 100 may be positioned between sections 112A and 112 B to seal the spray assembly and prevent leakage.

Figure 6:
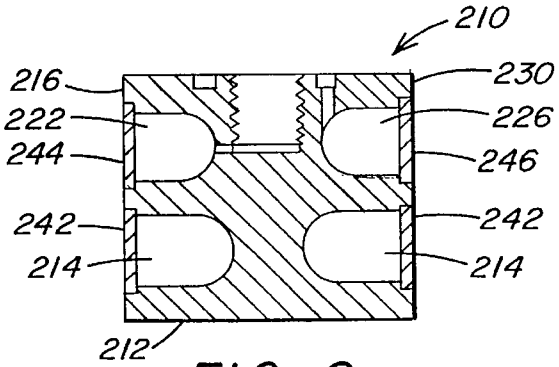
Figure 3:
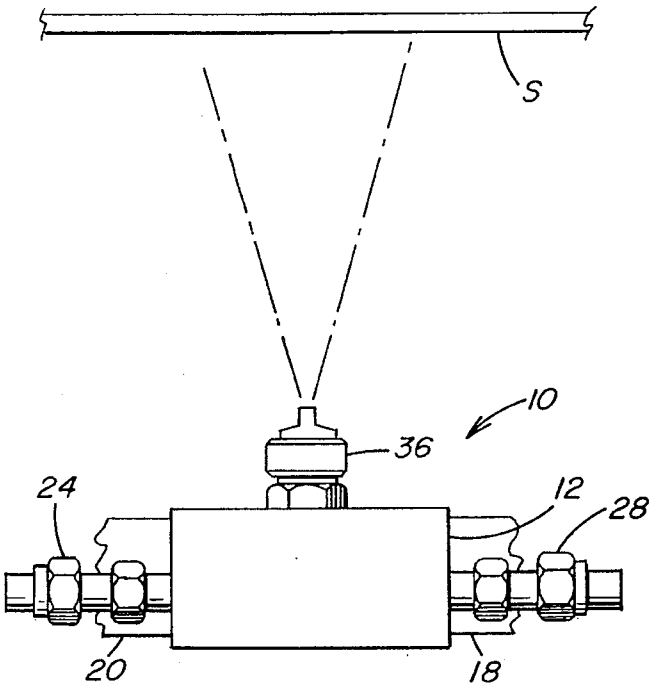
FIG. 3 is an end view of the spray arrangement of FIG. 1.

FIG. 6 illustrates another embodiment of the invention wherein the conduits are aligned in two rows within manifold 210. More particularly, liquid conduit 222 extends along surface 216 of bar 212 and gas conduit 226 extends along surface 230. Cooling conduit 214 is positioned below the liquid conduit 222 and extends along surface 216, around one end (not shown) of the manifold 210 and back along surface 230 below gas conduit 226. Plates 242, 244, and 246 seal conduits 214, 222 and 226, respectively.

Figure 7:
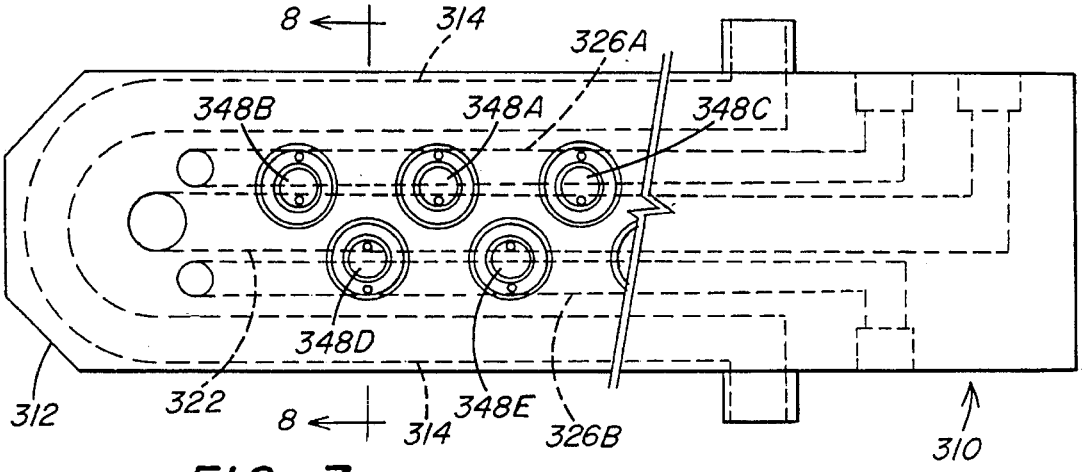
FIG. 7 is a plan view similar to that shown in FIG. 1 of an alternate spray arrangement, with portions removed for clarity.
Figure 8:
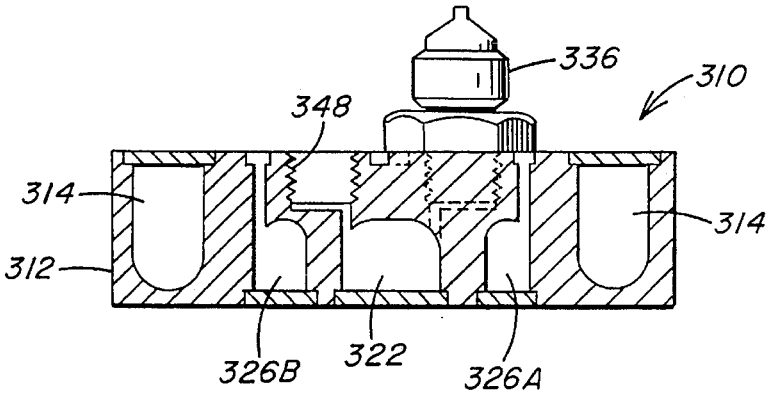
FIG. 8 is a cross-sectional view taken along line 8—8 of FIG. 7.

FIGS. 7 and 8 illustrate an alternate embodiment of the invention which incorporates two rows of nozzles. Manifold 310 includes a cooling conduit 314 extending about the periphery of bar 312. Gas conduits 326A and 326B extend along the length of the bar 312 between portions of cooling conduit 314. Liquid conduit 322 extends generally along the center of the bar 312 between gas conduits 326A and 326B. Although limited in the present invention, the two rows of receivers 348 shown in FIG. 7 which receive two sets of nozzles 336 (only one nozzle shown in FIG. 8), are positioned along manifold 310 in a staggered orientation. With this arrangement, depending on the nozzle spacing and the shape of the spray configuration, the spray from each nozzle may be overlapped by the sprays from up to four adjacent nozzles. More particularly, if the nozzles 336 have a conical spray distribution, the spray from nozzle at receiver 348A will be overlapped by the corresponding sprays from nozzles at receivers 348B, 348C, 348D and 348E. Such a nozzle arrangement may be used to ensure adequate coverage of the substrate by the spray. Bar 312 also includes ports, in a manner similar to that discussed earlier, to deliver the liquid from conduit 322 and gas from conduits 326A and 326B to the nozzles 336. It should be appreciated that additional rows of nozzles may be added to the manifold 310, with the liquid and gas being supplied to adjacent rows of nozzles by common conduits, in a manner as described above. It should be further appreciated that depending on the nozzle configuration, the embodiment of the invention illustrated in FIGS. 7 and 8 may be modified so that there are two liquid conduits and a single common gas conduit. As an alternative to using multiple gas and/or liquid conduits, a multiple row nozzle arrangement as shown in FIG. 7 may include a single liquid and gas conduit which generally parallel each other and extend in a serpentine configuration to deliver liquid and gas to each nozzle on the manifold 310.

Figure 9:
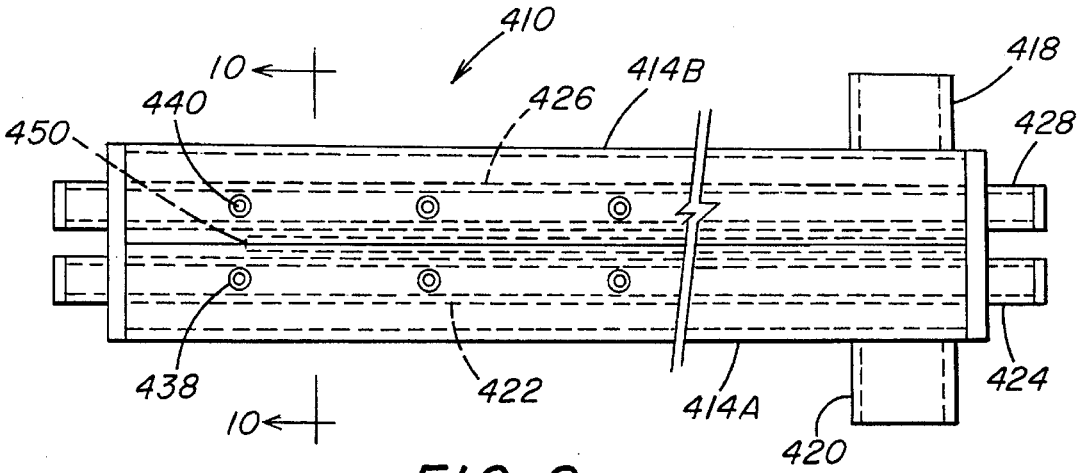
FIG. 9 is a plan view similar to that shown in FIG. 1 of another alternate spray arrangement, with portions removed for clarity.
Figure 10:
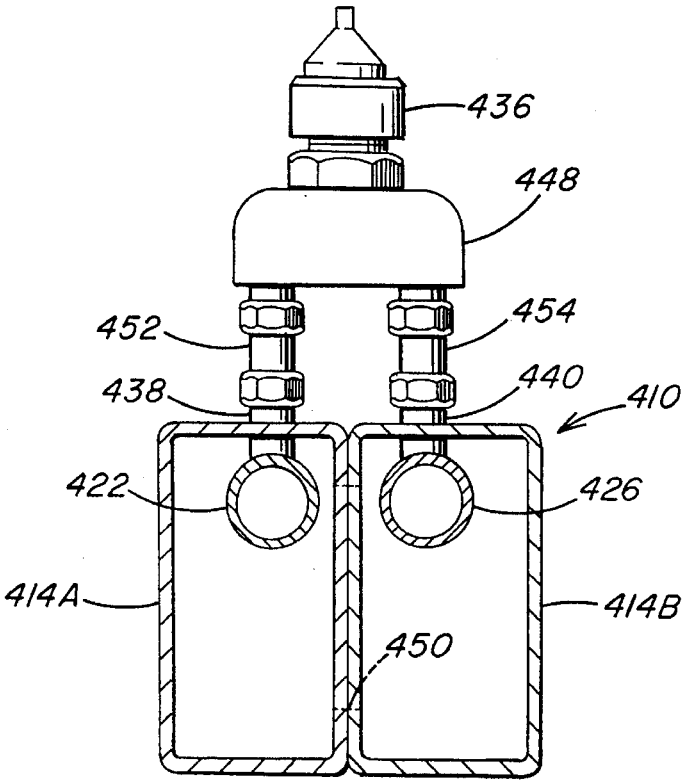
FIG. 10 is a cross-sectional view taken along line 10—10 of FIG. 9.

FIGS. 9 and 10 illustrate another embodiment of the present invention. Manifold 410 includes a liquid conduit 422, which includes an inlet 424 and extends through cooling pipe 414A, and a gas conduit 426, which includes an inlet 428 and extends through cooling pipe 414B. Pipes 414A and 414B are secured together along their length with opening 450 located at one end of the manifold 410 interconnecting the pipes so that coolant may enter the manifold 410 through coolant inlet 418, pass through pipe 414B, opening 450 and pipe 414A, and exit the manifold 410 through coolant outlet 420. A plurality of ducts 438 extend from liquid conduit 422 to above pipe 414A and a plurality of ducts 440 extend from gas conduit 426 to above pipe 414B. Each pair of ducts 438 and 440 connect the liquid and gas conduits to a nozzle assembly which includes a nozzle 436 secured to a receiver 448, in any convenient manner, e.g. compression fittings 452 and 454. In one particular embodiment of the invention, the receiver 448 is a model ¼JBC back connect and nozzle 436 is an external mix, flat spray nozzle model SUE 18B, both available from Spraying Systems Company.

The invention described and illustrated herein represents a description of illustrative preferred embodiments thereof. It is understood that various changes may be made without departing from the gist of the invention defined in the claims set to follow.

We claim:

1. A multiple nozzle liquid spray assembly comprising:

a longitudinally extending bar member;

receivers spaced along a surface of said member to allow securing of nozzles to said bar member;

a coolant conduit extending along at least a portion of said bar member;

a liquid conduit extending along said bar member in close proximity to each of said receivers;

a gas conduit extending along said bar member in close proximity to each of said receivers;

a first set of passages interconnecting each of said receivers with said liquid conduit; and a second set of passages interconnecting said gas conduit with said bar member surface, wherein said second set of passages extend to said surface in close proximity to said receivers.

2. The spray assembly as in claim 1 wherein said coolant conduit, said liquid conduit and said gas conduit are located within said bar member.

3. The spray assembly as in claim 1 wherein said coolant conduit, said liquid conduit and said gas conduit are a coolant channel, a liquid channel and a gas channel, respectively, extending along at least one surface of said bar member and further including plate members to seal each of said channels to form said respective conduits.

4. The spray assembly as in claim 1 further including a coolant inlet and coolant outlet, wherein said coolant conduit includes a first portion extending from said coolant inlet and positioned along a first longitudinal side of said bar member and a second portion extending from said coolant outlet and positioned along an opposing longitudinal side of said bar member.

5. The spray assembly as in claim 4 wherein said liquid conduit and gas conduit extend along said bar member between said first and second portions of said cooling conduit.

6. The spray assembly as in claim 1, further including means to distribute gas along said bar member surface in the vicinity of said receiver.

7. The spray assembly as in claim 6 wherein said distributing means includes a groove along said bar member surface surrounding at least a portion of said receiver.

8. The spray assembly as in claim 4 wherein said gas conduit is adjacent said liquid conduit and said first portion of said coolant conduit, said liquid conduit is adjacent said gas conduit and said second portion of said coolant conduit, and said first portion of said coolant conduit is adjacent to said second portion of said coolant conduit.

9. The spray assembly as in claim. 1 wherein said liquid and gas conduits generally parallel each other along said bar member.

10. The spray assembly as in claim 1 wherein said receivers are a first set of receivers for a first row of nozzles and said liquid conduit is a first liquid conduit positioned in close proximity to said first set of receivers and further including a second set of receivers along said member surface to allow securing of a second row of nozzles to said bar assembly, a second liquid conduit extending along said bar member in close proximity to said second set of receivers, a third set of passages interconnecting said second liquid conduit with each of said second set of receivers, and a fourth set of passages interconnecting said gas conduit with said bar member surface, wherein said fourth set of passages extend to said member surface in close proximity to said second set of receivers.

11. The spray assembly as in claim 10 wherein said liquid and gas conduits generally parallel each other along said bar member.

12. The spray assembly as in claim 1 wherein said receivers are a first set of receivers for a first row of nozzles and said gas conduit is a first gas conduit positioned in close proximity to said first set of receivers and further including a second set of receivers along said member surface to allow securing of a second row of nozzles to said bar assembly, a second gas conduit extending along said bar member in close proximity to said second set of receivers, a third set of passages interconnecting said second gas conduit with said bar member surface, wherein said third set of passages extend to said member surface in close proximity to said second set of receivers, and a fourth set of passages interconnecting said liquid conduit with said second set of receivers.

13. The spray assembly as in claim 12 wherein said liquid and gas conduits generally parallel each other along said bar member.

14. The spray assembly as in claim 1 wherein said liquid conduit includes at least one liquid inlet and said gas conduit includes at least one gas inlet.

15. The spray assembly as in claim 1 wherein said first and second sets of passages and at least a portion of each of said conduits are formed by said bar member.

16. A multiple nozzle liquid spray assembly comprising:

a longitudinally extending bar member;

receivers to allow securing of nozzles along said bar member;

a coolant conduit extending along at least a portion of said bar member;

at least one liquid conduit extending along said bar member in close proximity to each of said receivers;

at least one gas conduit extending along said bar member in close proximity to each of said receivers;

a first set of passages interconnecting each of said receivers with said liquid conduit; and a second set of passages to interconnect each of said receivers with said gas conduit, wherein said passages and at least a portion of each of said conduits are formed by said bar member.

17. A multiple nozzle spray assembly comprising:

first and second longitudinally extending coolant pipes;

means to interconnect said pipes to allow coolant to flow from one of said pipes to the other of said pipes;

a liquid conduit extending through one of said pipes;

a gas conduit extending through the other of said pipes;

a first set of ducts extending from said liquid conduit to a nozzle receiver; and a second set of ducts extending from said gas conduit to said nozzle receiver.

18. A multiple nozzle spray assembly comprising:

an elongated housing;

a plurality of nozzles mounted in spaced relation along a surface of said housing;

a coolant conduit extending within at least a portion of said housing;

a liquid conduit extending within said housing in close proximity to said nozzles;

a first set of passages extending through and formed by said housing to interconnect said liquid conduit with each of said nozzles;

a gas conduit extending within said housing in close proximity to said nozzles; and a second set of passages extending through and formed by said housing to interconnect said gas conduit with each of said nozzles.

19. The spray assembly as in claim 18 wherein said coolant conduit, said liquid conduit and said gas conduit are a coolant channel, a liquid channel and a gas channel, respectively, extending along surfaces of said housing and further including plate members to seal each of said channels to form said respective conduits.

20. A multiple nozzle liquid spray assembly comprising:

a longitudinally extending bar member with a first section having a first coolant channel, a first liquid channel and a first gas channel extending along a first surface of said first section, and a second section having a second coolant channel, a second liquid channel and a second gas channel positioned extending along a second surface of said second section, a gasket positioned between said first and second sections, and means to join said first and second sections together, wherein said first and second coolant channels form a coolant conduit, said first and second liquid channels form a liquid conduit and said first and second gas channels form a gas conduit;

nozzle receivers positioned along a third surface of said first section of said bar member in close proximity to said liquid and gas conduits;

a first set of passages interconnecting each one of said receivers with said liquid conduit; and a second set of passages interconnecting said gas conduit with said third surface, wherein said second passages extend to said third surface in close proximity to said nozzle receivers.

* * * * *